US008421720B2

(12) United States Patent
He et al.

(10) Patent No.: US 8,421,720 B2
(45) Date of Patent: Apr. 16, 2013

(54) LCD AND CIRCUIT ARCHITECTURE THEREOF

(75) Inventors: Chengming He, Shenzhen (CN); Dongsheng Guo, Shenzhen (CN); Liangchan Liao, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 319 days.

(21) Appl. No.: 12/997,696

(22) PCT Filed: Sep. 1, 2010

(86) PCT No.: PCT/CN2010/076546

§ 371 (c)(1),
(2), (4) Date: Dec. 13, 2010

(87) PCT Pub. No.: WO2012/006804

PCT Pub. Date: Jan. 19, 2012

(65) Prior Publication Data

US 2012/0013589 A1 Jan. 19, 2012

(30) Foreign Application Priority Data

Jul. 14, 2010 (CN) ..... 2010 1 0230801

(51) Int. Cl.
*G09G 3/36* (2006.01)
*G09G 5/00* (2006.01)

(52) U.S. Cl.
USPC ..... 345/80; 345/211; 345/100; 345/206; 349/149; 349/150

(58) Field of Classification Search ..... 345/80, 345/211, 100, 206; 349/149, 150
See application file for complete search history.

(56) References Cited

U.S. PATENT DOCUMENTS

| | | | | |
|---|---|---|---|---|
| 6,211,849 | B1 * | 4/2001 | Sasaki et al. | 345/87 |
| 6,388,651 | B1 * | 5/2002 | Kinoshita et al. | 345/98 |
| 6,842,164 | B2 * | 1/2005 | Imajo et al. | 345/206 |
| 7,433,008 | B2 | 10/2008 | Kim | |
| 7,773,187 | B2 * | 8/2010 | Takenaka et al. | 349/150 |
| 2003/0067576 | A1 | 4/2003 | Cho | |
| 2005/0168426 | A1 * | 8/2005 | Moon et al. | 345/98 |

FOREIGN PATENT DOCUMENTS

| | | | |
|---|---|---|---|
| CN | 1495686 | A | 5/2004 |
| CN | 1570718 | A | 1/2005 |
| CN | 1959478 | A | 5/2007 |

* cited by examiner

*Primary Examiner* — Kevin M Nguyen
(74) *Attorney, Agent, or Firm* — Ditthavong Mori & Steiner, P.C.

(57) ABSTRACT

A liquid crystal display (LCD) and circuit architecture thereof are proposed. Power signal lines, data signal lines, and control signal lines are mounted on a printed circuit board (PCB) and a thin film substrate. The thin film substrate is connected to a LCD panel by using a COF bonding. These circuits can be transferred onto a conductive glass of the panel and subsequently onto source driver chips of the thin film substrate of the COF. Therefore, a position which needs the least time for power signal lines, data signal lines, and control signal lines to transmit to all of the circuits of the panel on the PCB can be calculated in order to achieve the best design.

10 Claims, 2 Drawing Sheets

LCD AND CIRCUIT ARCHITECTURE THEREOF

BACKGROUND OF THE INVENTION

1. Field of the Invention

The present invention relates to a liquid crystal display (LCD) and circuit architecture thereof, and more particularly, to an LCD improving power and signal supplies for source driver chips and circuit architecture thereof.

2. Description of Prior Art

With a rapid development of monitor types, novel and colorful monitors with high resolution, e.g., liquid crystal displays (LCDs), are indispensable components used in various electronic products such as monitors for notebook computers, personal digital assistants (PDAs), digital cameras, and projectors. The demands for the novel and colorful monitors have increased tremendously.

There are three ways to connect substrates and driver ICs during an LCD manufacturing process: a tape automated bonding (TAB), a chip on film (COF), and a chip on glass (COG). For the TAB and the COF technologies, driver ICs are bonded onto flexible printed circuits (FPCs) which are bonded onto glass substrates. As for the COG technology, driver ICs are directly bonded onto glass substrates.

The TAB basically consists of three layers, using polyimide (PI) as a substrate and adhesive to bond polyimide (PI) and copper foil. The inner lead bonding (ILB) adopts an eutectic bonding technology; the contact structure is protected with underfill dispensing; the outer lead bonding (OLB) adopts a package mode that glass panels are bonded with tape. Thus, the TAB is mainly applied to large-sized panels and related products.

The COF, consists of a two-layered FPC, does not have an adhesive layer as a traditional TAB does, so it is relatively thinner and softer and can offer better flexibility. Basically, the COF uses flip-chip bonding technology; that is, one or more chips, passive elements, or active elements are packaged on tapes. Driver ICs packaged with the flip-chip bonding technology will become multifunctional integrated chipsets and further, be able to reduce size.

For improving overall image quality and reducing the overall cost, a number of pins of driver ICs increases while the conductor spaces shorten. So the bonding process is the key to the whole manufacturing process for driver ICs, which implies that the bonding process takes high proportion of the total production cost. Thus, it is a critical issue to manage how to reduce the cost.

Please refer to FIG. 1. FIG. 1 is a circuit architecture diagram illustrating a panel power signal and related signals via source drivers. For a large-sized liquid crystal (LC) panel 10 adopting the COF technology, the long side of the LC panel 10 requires a printed circuit board (PCB) 12 to connect to the source driver chips 14 mounted on a thin film substrate 16. Then, an input interface 18 transmits control signals, data signals, and power signals generated by a timing controller and a power controller (not shown in FIG. 1) to each of the source driver chips 14 through control signal lines 22*a* and 22*b*, data signal lines 24*a* and 24*b*, and power signal lines 26*a* and 26*b* to activate the LC panel 10. The larger the LC panel 10 is, the larger the PCB 12 requires. However, because of limitations in the current manufacturing of PCBs 12, a traditional solution is to use several of the PCBs 12 to connect all of the source driver chips 14. In this way, the size of the LC panel 10 determines the size and numbers of the PCB 12. The larger the LC panel 10 is, the larger and the more the PCB 12 requires.

SUMMARY OF THE INVENTION

Therefore, the main object of the present invention is to provide an LCD and circuit architecture thereof to simplify PCB and LC panel designs and to reduce PCB size. PCBs can remain the same size no matter what size of a panel. Besides, transmitting signals are consistent so modules can be reused. This can save on costs of materials.

According to the present invention, a liquid crystal display comprises a liquid crystal display panel, a printed circuit board, a first thin film substrate, a plurality of second thin film substrates, and a plurality of source driver chips. The printed circuit board comprises an input interface, two power signal lines, two data signal lines, and two control signal lines. The two power signal lines, the two data signal lines, and the two control signal lines are used to respectively transmit power signal, data signal, and control signal from the input interface. The first thin film substrate comprises one end connected to the liquid crystal display panel, and the other end connected to the printed circuit board. The two power signal lines, the two data signal lines, and the two control signal lines are disposed on the first thin film substrate. The plurality of second thin film substrates are connected to one end of the liquid crystal display panel. The first thin film substrate is positioned among the plurality of second thin film substrates. Each source driver chip is positioned on one of the second thin film substrate. The power signal, the data signal, and the control signal are transmitted between two source driver chips through the two power signal lines, the two data signal lines, and the two control signal lines on the second thin film substrate and the liquid crystal display panel. The two power signal lines, the two data signal lines, and the two control signal lines are disposed between every two second thin film substrates on the liquid crystal display panel.

In one aspect of the present invention, a plurality of gate driver chips and a plurality of third thin film substrates are connected to the liquid crystal display. Each gate driver chip is disposed on one of the third thin film substrates, and the plurality of third thin film substrates are connected to the liquid crystal display. One of the gate driver chips transmits the power signal and the control signal through the power signal lines and the control signal lines on the second thin film substrate. The first thin film substrate is positioned among the plurality of second thin film substrates at a position which forms a route for delivering the control signal and the power signal from the input interface to all source driver chips in a least period of time.

In another aspect of the present invention, the first thin film substrate is positioned in a middle alignment of the source drivers.

In still another one aspect of the present invention, the plurality of source driver chips comprises a first set of source driver chips and a second set of source driver chips, and the first thin film substrate is disposed in between the first set of source driver chips and the second set of source driver chips which are disposed on the plurality of second thin film substrates.

According to the present invention, a circuit architecture of providing power and signal to source driver chips is proposed. The circuit architecture comprises a liquid crystal display panel, a printed circuit board, a first thin film substrate, a plurality of second thin film substrates, and a plurality of source driver chips. The printed circuit board comprises an input interface, two power signal lines, two data signal lines, and two control signal lines. The two power signal lines, the two data signal lines, and the two control signal lines are used to respectively transmit power signal, data signal, and control signal from the input interface. The first thin film substrate comprises one end connected to the liquid crystal display panel, and the other end connected to the printed circuit board. The two power signal lines, the two data signal lines, and the two control signal lines are disposed on the first thin film substrate. The plurality of second thin film substrates are connected to one end of the liquid crystal display panel. The first thin film substrate is positioned among the plurality of second thin film substrates. Each source driver chip is positioned on one of the second thin film substrate. The power signal, the data signal, and the control signal are transmitted between two source driver chips through the two power signal lines, the two data signal lines, and the two control signal lines on the second thin film substrate and the liquid crystal display panel. The two power signal lines, the two data signal lines, and the two control signal lines between every two second thin film substrates are disposed on the liquid crystal display panel.

Compared with the prior art, the present invention provides an LCD and circuit architecture thereof to simplify PCB and LC panel designs and to reduce the area of PCBs and the amount of anisotropic conductive film (ACF), which is now only required to apply between a first thin film substrate and a PCB. That the size of PCBs does not change with the variations of the size of panels and that modules are reusable under conditions of consistent transmitting signals used, reduces manufacturing costs. Moreover, that PCBs are connected to a reasonable position shortens data transfer time and further improves the response time of panels.

These and other objectives of the present invention will become apparent to those of ordinary skill in the art after reading the following detailed description of the preferred embodiment that is illustrated in the various figures and drawings.

DETAILED DESCRIPTION OF THE PREFERRED EMBODIMENTS

Figure 1:
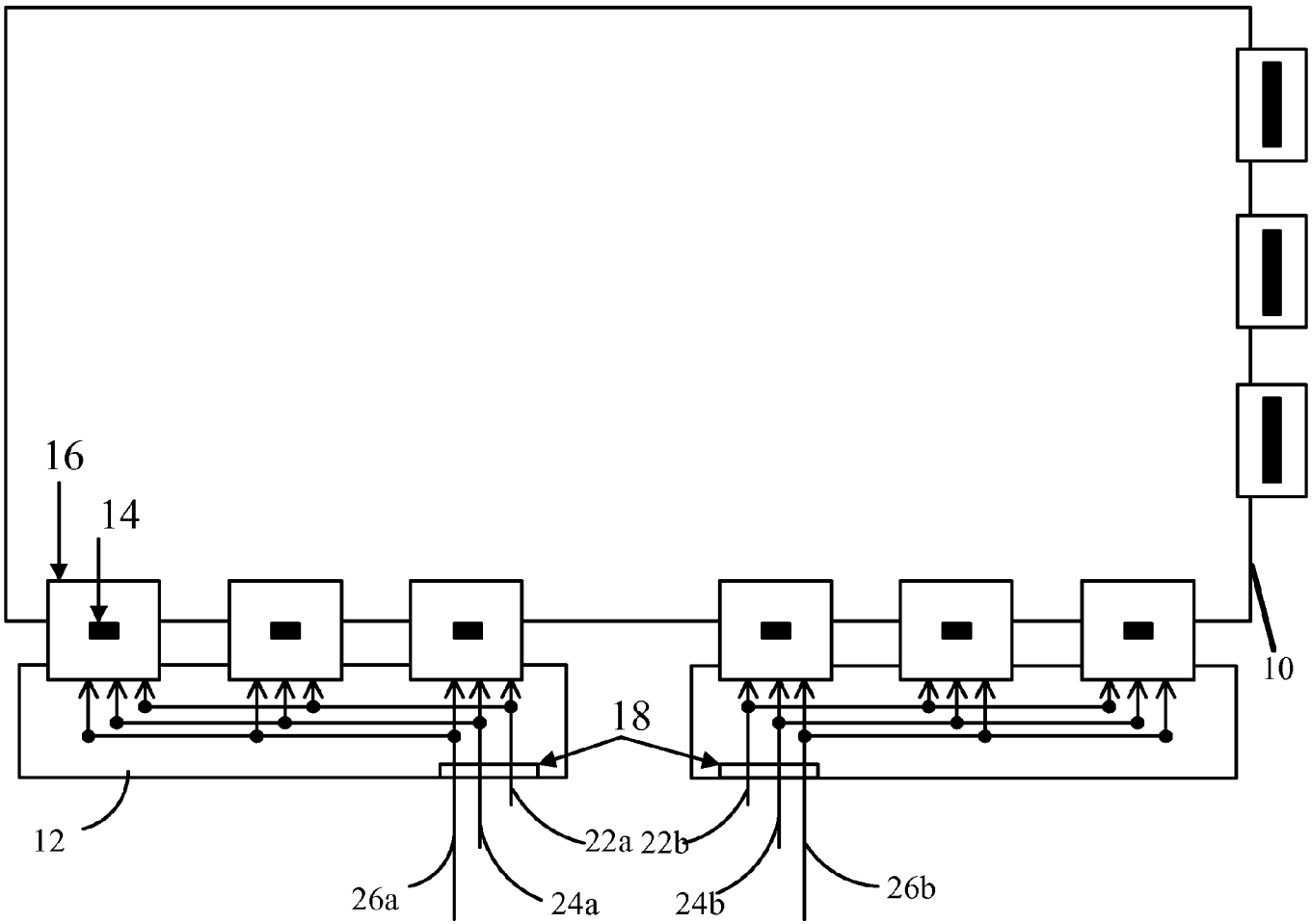
FIG. 1 (PRIOR ART)
FIG. 1 is a circuit architecture diagram illustrating a panel power signal and related signals via source drivers.
Figure 2:
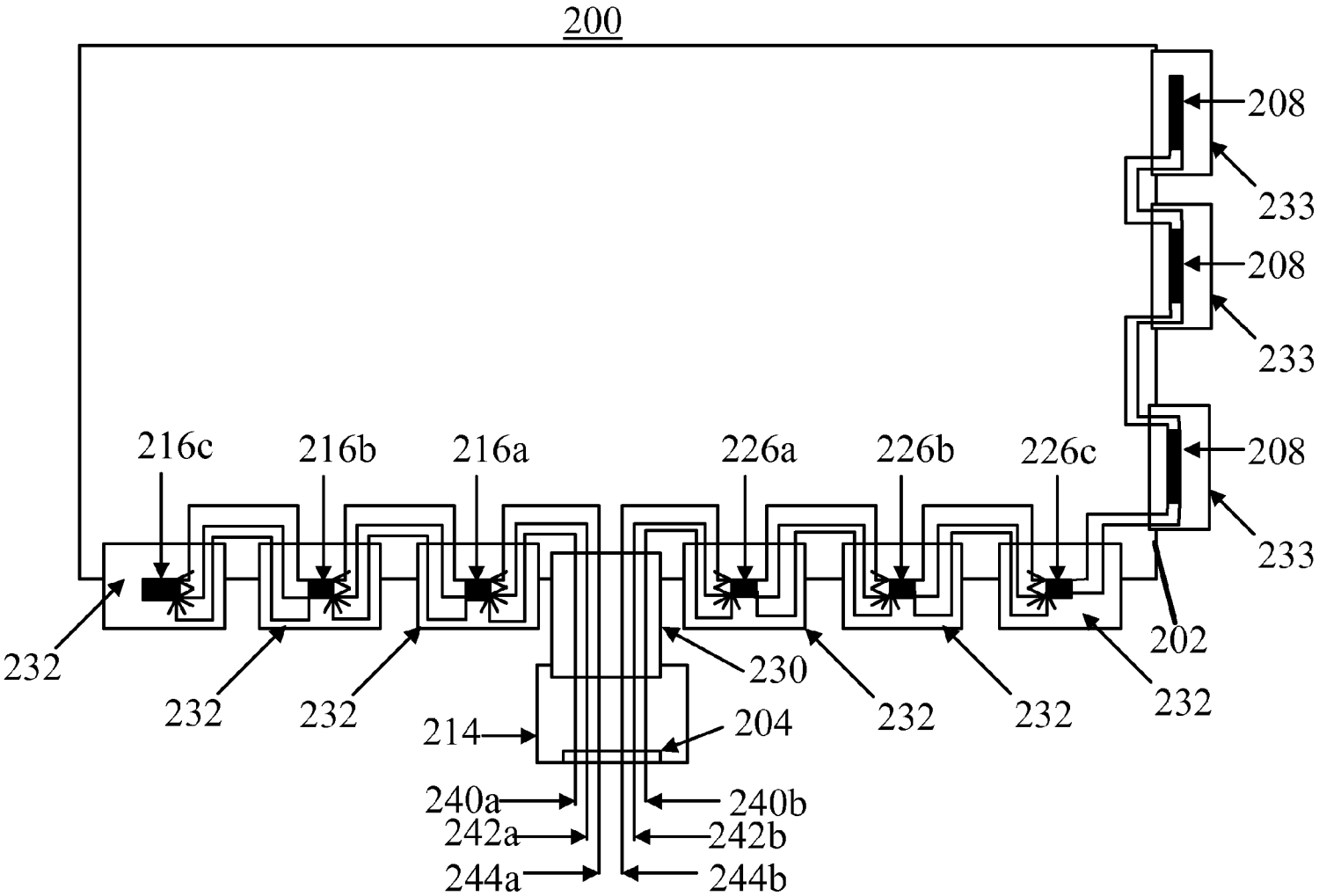
FIG. 2 is a schematic diagram illustrating a liquid crystal display of the embodiment of the present invention.

Please refer to FIG. 2, which is a schematic diagram illustrating a liquid crystal display (LCD) 200 according to an embodiment of the present invention. The LCD 200 comprises a liquid crystal (LC) panel 202, an input interface 204, a printed circuit board (PCB) 214, a plurality of source driver chips 216*a*-216*c* and 226*a*-226*c*, a plurality of d gate driver chips 208, a first thin film substrate 230, a plurality of second thin film substrate 232, and a plurality of third thin film substrate 233. The LC panel 202 comprises an LC layer overlapping with a conductive glass substrate. Both of the first thin film substrate 230 and the second thin film substrate 232 are connected to the conductive glass substrate of the LC panel 202. The input interface 204 receives control signals, data signals, and power signals generated by a timing controller and a power controller (not shown in FIG. 2). The control signal lines 240*a* and 240*b*, the data signal lines 242*a* and 242*b*, and the power signal lines 244*a* and 244*b*, are disposed between the first thin film substrate 230 and the second thin film substrate 232, and are also disposed on the conductive glass substrate of the LC panel 202 through every other second thin film substrate 232. Thus, the control signals, the data signals, and the power signals are transmitted to the plurality of gate driver chips 208 and source driver chips 216*a*-216*c* and 226*a*-226*c* via control signal lines 240*a* and 240*b*, data signal lines 242*a* and 242*b*, and power signal lines 244*a* and 244*b*. Although FIG. 2 illustrates six source driver chips 216*a*-216*c* and 226*a*-226*c*, and three gate driver chips 208, the number of source driver chips and gate driver chips can be adjusted with different sizes of an LCD. The first thin film substrate 230 and the PCB 214 are adhered to each other by using an anisotropic conductive film (ACF).

The source driver chips 216*a*-216*c* and 226*a*-226*c*, and the plurality of gate driver chips 208 are disposed on the second thin film substrate 232 and the third thin film substrates 233 based on the COF technology. The plurality of source driver chips are enabled from two ends; that is, the source driver chips 216*a*-216*c* and 226*a*-226*c* are divided into a first set of source driver chips and a second set of source driver chips. The first set of source driver chips 216*a*-216*c* is connected in serial; similarly, the second set of source driver chips 226*a*-226*c* is connected in serial as well. The source driver chip of the first source driver chipset 216*a* is connected to the input interface 204, and the source driver chip of the second source driver chipset 226*a* is also electrically connected to the input interface 204. The control signals, data signals, and power signals which are generated by the input interface 204 are transmitted to the source driver chip 216*a* via the control signal line 240*a*, the data signal line 242*a*, and the power signal line 244*a*. Afterwards, the three types of signals are sequentially transmitted to the remaining of the first source driver chips 216*b*-216*c*. Similarly, the control signals, data signals, and power signals which are generated by the input interface 204 are transmitted to the source driver chip 226*a* via the control signal line 240*b*, the data signal line 242*b*, and the power signal line 244*b*. Afterwards, the three types of signals are sequentially transmitted to the second source driver chips 226*b*-226*c*. The input interface 204 also generates the control signal and the power signal to the gate driver chips 208 on the third thin film substrate 233 to enable and control the operation of the gate driver chips 208. A control signal line and power signal line between the third thin film substrates 233 are disposed on the conductive glass substrate of the LC panel 202.

The gate driver chips 208 generate scanning signals to the LC panel 202, and afterwards, the pixels in each row of the LC panel 202 are sequentially turned on. Meanwhile, the input interface 204 emits the control signals, power signals, and data signals to the source driver chip 216*a*. Upon receiving the power signals, the source driver chip 216*a* enables and receives the data signals transmitted from the input interface 204 and then transmits the control signals to the next source driver chip 216*b*. Similarly, upon receiving the power signals, the source driver chip 216*b* enables and receives the data signals transmitted from the input interface 204 and then transmits the control signals to the next source driver chip 216*c*. The process is repeated until the control signals are transmitted to the last source driver chip. The data signals, power signals, and control signals are transmitted by the source driver chips 226*a*-226*c* in a similar manner. Finally, the data signals which are outputted by the source driver chips 216*a*-216*c* and 226*a*-226*c*, are received by the straight-rowed pixels of the LC panel 202. The straight-rowed pixels are charged to each pixel's individually required voltage to show various gray scales.

Preferably, both the first thin film substrate 230 and the PCB 214 are positioned, but not limited to be, in a middle alignment of the source driver chips 216*a*-216*c* and 226*a*-226*c*. In another embodiment, the first thin film substrate 230 is positioned at a position which forms a route for delivering the control signal and the power signal from the input interface 204 to all source driver chips 216*a*-216*c* and 226*a*-226*c* in a least period of time. As a person skilled in this art is aware, the position relating to the least period of time depends on the size of the LCD panel and the material of the signal lines, and is thus not discussed in detailed in this application. For example, if the period of time for delivering a signal from the input interface 204 through the source driver chips 226*a*, 226*b*, 216*a*-216*c*, and the signal delivering route is shortest from the source driver chip 226*c* to the last gate driver chip 208, then positioning the first thin film substrate 230 and the PCB 214 between the source driver chips 226*b* and 226*c* is optional.

The first thin film substrate 230 and the PCB 214 are positioned in a middle alignment of the source driver chips 216*a*-216*c* and 226*a*-226*c*, so the data transfer time of the present invention is shorter than that of a traditional LCD. The response time of panels can be improved accordingly.

Although the present invention has been explained by the embodiments shown in the drawings described above, it should be understood to the ordinary skilled person in the art that the invention is not limited to the embodiments, but rather various changes or modifications thereof are possible without departing from the spirit of the invention. Accordingly, the scope of the invention shall be determined only by the appended claims and their equivalents.

What is claimed is:

1. A liquid crystal display comprising a liquid crystal display panel, characterized in that the liquid crystal display further comprises:

a printed circuit board comprises an input interface, two power signal lines, two data signal lines, and two control signal lines; the two power signal lines, the two data signal lines, and the two control signal lines respectively transmit power signal, data signal, and control signal from the input interface;

a first thin film substrate comprises one end connects to the liquid crystal display panel, and the other end connects to the printed circuit board, the two power signal lines, the two data signal lines, and the two control signal lines are disposed on the first thin film substrate thereof;

a plurality of second thin film substrates, connects to one end of the liquid crystal display panel, the first thin film substrate is positioned among the plurality of second thin film substrates; and a plurality of source driver chips, each source driver chip is positioned on one of the second thin film substrate; the power signal, the data signal, and the control signal transmit between two source driver chips through the two power signal lines, the two data signal lines, and the two control signal lines on the second thin film substrate and the liquid crystal display panel, wherein the two power signal lines, the two data signal lines, and the two control signal lines between every two second thin film substrates are disposed on the liquid crystal display panel.

2. The liquid crystal display of claim 1, characterized in that the liquid crystal display further comprises a plurality of gate driver chips and a plurality of third thin film substrates connecting to the liquid crystal display, each gate driver chip disposed on one of the third thin film substrates, and the plurality of third thin film substrates connecting to the liquid crystal display, wherein one of the gate driver chips transmits the power signal and the control signal through the power signal lines and the control signal lines on the second thin film substrate.

3. The liquid crystal display of claim 2, characterized in that the first thin film substrate is positioned among the plurality of second thin film substrates at a position which forms a route for delivering the control signal and the power signal from the input interface to all source driver chips in a least period of time.

4. The liquid crystal display of claim 1, characterized in that the first thin film substrate is positioned in a middle alignment of the source drivers.

5. The liquid crystal display of claim 1 wherein the plurality of source driver chips comprises a first set of source driver chips and a second set of source driver chips, and the first thin film substrate is disposed in between the first set of source driver chips and the second set of source driver chips which are disposed on the plurality of second thin film substrates.

6. A circuit architecture of providing power and signal to source driver chips, characterized in that the circuit architecture further comprises:

a liquid crystal display panel;

a printed circuit board comprises an input interface, two power signal lines, two data signal lines, and two control signal lines; the two power signal lines, the two data signal lines, and the two control signal lines respectively transmit power signal, data signal, and control signal from the input interface;

a first thin film substrate comprises one end connects to the liquid crystal display panel, and the other end connects to the printed circuit board, the two power signal lines, the two data signal lines, and the two control signal lines are disposed on the first thin film substrate;

a plurality of second thin film substrates, connects to one end of the liquid crystal display panel, the first thin film substrate is positioned among the plurality of second thin film substrates; and a plurality of source driver chips, each source driver chip is positioned on one of the second thin film substrate; the power signal, the data signal, and the control signal being transmitted between two source driver chips through the two power signal lines, the two data signal lines, and the two control signal lines on the second thin film substrate and the liquid crystal display panel, wherein the two power signal lines, the two data signal lines, and the two control signal lines between every two second thin film substrates are disposed on the liquid crystal display panel.

7. The circuit architecture of claim 6, characterized in that the circuit architecture further comprises a plurality of gate driver chips and a plurality of third thin film substrates connecting to the liquid crystal display, each gate driver chip disposed on one of the third thin film substrates, and the plurality of third thin film substrates connecting to the liquid crystal display, wherein one of the gate driver chips transmits the power signal and the control signal through the power signal lines and the control signal lines on the second thin film substrate.

8. The circuit architecture of claim 7, characterized in that the first thin film substrate is positioned among the plurality of second thin film substrates at a position which forms a route for delivering the control signal and the power signal from the input interface to all source driver chips in a least period of time.

9. The circuit architecture of claim 6, characterized in that the first thin film substrate is positioned in a middle alignment of the source drivers.

10. The circuit architecture of claim 6, characterized in that the plurality of source driver chips comprises a first set of source driver chips and a second set of source driver chips, and the first thin film substrate is disposed in between the first set of source driver chips and the second set of source driver chips which are disposed on the plurality of second thin film substrates.

* * * * *